United States Patent [19]

Himi

[11] Patent Number: 4,565,329

[45] Date of Patent: Jan. 21, 1986

[54] FOOD SLICER

[75] Inventor: Kohei Himi, Mie, Japan

[73] Assignee: Chubu Industries, Inc., Mie, Japan

[21] Appl. No.: 631,377

[22] Filed: Jul. 16, 1984

[30] Foreign Application Priority Data

Feb. 24, 1984 [JP] Japan ..... 59-33994
Apr. 27, 1984 [JP] Japan ..... 59-85847

[51] Int. Cl.[4] ..... B02C 18/16

[52] U.S. Cl. ..... 241/95; 83/403; 241/285 R; 241/DIG. 17

[58] Field of Search ..... 83/403; 241/DIG. 17, 241/95, 89.3, 89.4, 92, 246, 248, 257 R, 261.1, 285 R, 285 A

[56] References Cited

U.S. PATENT DOCUMENTS 4,055,099 10/1977 Mitsubayashi ..... 241/DIG. 17 X

*Primary Examiner*—Mark Rosenbaum
*Attorney, Agent, or Firm*—Fulbright & Jaworski

[57] ABSTRACT

In a food slicer, a frame is mounted to posts standing uprightly on a base, a cutting plate is removably secured to an upper portion of the frame, and a transfer rotor is removably secured to an upper portion of a rotary shaft which passes through the frame and the cutting plate to extend upwards. The rotary shaft is rotatably supported by the frame and driven by a drive member disposed beneath the cutting plate. A hood is mounted to the base, for surrounding a region in which the drive member beneath the frame is arranged. The hood is mounted with a discharge chute which passes through an opening formed in the frame to reach an opening in the cutting plate for insertion of a cutting blade. The frame is connected with a drain pipe.

5 Claims, 13 Drawing Figures

FOOD SLICER

BACKGROUND OF THE INVENTION

This invention relates to a food slicer for slicing solid food stuffs such as lumps of ice, frozen fruits and the like.

As disclosed in U.S. Pat. No. 4,055,099, for example, this type of food slicer has hitherto been known which comprises a cutting plate having a plate body mounted, at its rear surface, with a cutting blade having a edge which passes through an opening formed in the plate body and projects beyond the surface thereof, a transfer rotor mounted to an upper portion of a rotary shaft which passes through a central hole in the cutting plate to extend beyond the cutting plate and including a hopper secured to an upper portion of the transfer rotor, and a drive member, disposed beneath the cutting plate, for rotating the rotary shaft.

This conventional slicer faces no serious problem in shaving or slicing an object such as a lump of ice containing water alone as constituent. But when shaving frozen fruits to prepare a sherbet with this slicer, the remnants of fruits deposit on the rear surface of the cutting plate or its neighbouring portions, raising inconvenience bad for sanitation. In making an attempt to eliminate the remnants, it is impossible or very difficult to clean the interior of the transfer rotor and the cutting plate for the sake of removing the remnants because in the conventional slicer, the transfer rotor is forcibly fitted on the rotary shaft with knurling for prevention of idle rotation, making it very difficult to remove the transfer rotor, and the cutting plate is also difficult to remove from the base.

SUMMARY OF THE INVENTION

This invention contemplates elimination of the above drawbacks of the conventional food slicer and has for its object to provide a food slicer wherein a cutting plate and a transfer rotor can be removed from a base readily for their cleaning and the remnants of shaved foodstuffs can readily be eliminated from these members.

To accomplish the above object, according to this invention, in the known food slicer as described above, the cutting plate is removably mounted to a frame which is mounted to posts standing uprightly on a base below the cutting plate, the frame rotably supports a rotary shaft having an upper portion to which the transfer rotor is removably secured, and the base is mounted with a discharge chute passing through an opening formed in the frame to abut, at its upper end, against a circumferential portion contiguous to an opening formed in the cutting plate. When it is desired to clean the transfer rotor and the cutting plate which are more or less deposited with the remnants of solid foodstuffs after shaving the same, the transfer rotor is first removed from the upper portion of the rotary shaft and thereafter, the cutting plate is removed from the frame. These members are cleaned on the outside of the slicer. After completion of the cleaning, these members are returned and held in place for reassembling through reverse procedures.

Another object of this invention is to provide a food slicer wherein the surface of the frame can be cleaned as it remains mounted to the posts and water for cleaning is prevented from intruding into the interior of a hood beneath the frame, thereby preventing the cleaning water from soiling a drive member and the like arranged on the base inside the hood.

This object can be accomplished by an embodiment of this invention wherein the frame is constituted by a leakage preventive plate taking the form of a closed plate except for the opening through which the discharge chute passes, the frame is connected with a drain pipe which passes through the hood to extend downwardly, a cylindrical apron is arranged to surround the discharge chute, and the opposite ends of the apron are contiguous to the rear surface of the frame and the surface of the hood, respectively. According to this embodiment, the cleaning water used to clean the surface of the frame is discharged to the outside of slicer via the drain pipe and the apron, thereby being prevented from intruding into the interior of the hood.

Still another object of this invention is to provide a food slicer wherein the cutting plate can readily be engaged with or disengaged from the frame, and under the engagement, the cutting plate can be supported stably on the frame at a predetermined spacing therebetween.

This object can be accomplished by an embodiment of this invention wherein the frame has, on its peripheral edge portion, a pair of lateral U-shaped projections arranged in diametrically opposite relationship with respect to a center of a bearing hole for the rotary shaft and having identical openings in the horizontal direction, the frame further has, on its peripheral edge portion, a plurality of projections which are circumferentially equidistantly spaced, each of the projections has an inner low step portion, and the plate body of the cutting plate has a pair of outwardly projecting pins which engage or disengage the openings of the lateral U-shaped projections and further has flat portions which rest on the low step portions of the projection when the pins engage the openings of the lateral U-shaped projections. According to this embodiment, the lateral U-shaped projection of the frame cooperates with the pin of the cutting plate to establish a bayonet mechanism so that engagement or disengagement can be effected by simply moving the cutting plate relative to the frame in the horizontal plane, and the spacing between the frame and the cutting plate can be maintained readily and stably by causing the flat portion of the cutting plate to rest on the low step portion of projection of the frame.

Still another object of this invention is to provide a food slicer wherein, in an arrangement in which the hopper mounted to an upper portion of the transfer rotor is surrounded by a cover removably mounted to the frame and an openable lid is mounted to the cover so as to prevent the object to be sliced from being scattered during slicing, when the lid is closed for slicing or the cover is removed for cleaning, an accidental rotation of the transfer rotor can be prevented so as not to injure the operator and not to scatter the object to be sliced.

This object can be accomplished by an embodiment wherein the lid is pivotally mounted to the cover to open or close an opening thereof, and a safety switch is mounted to the frame, which safety switch is turned on only when the lid is closed and is connected to the drive member for rotating the transfer rotor. Thus, according to this embodiment, when the lid is opened by removing the cover or turning the lid, the safety switch can automatically be turned off so that even in the event that the operator turns on the main switch inadvertently, the actuation of the drive member can be prevented.

DESCRIPTION OF PREFERRED EMBODIMENTS

Figure 1:
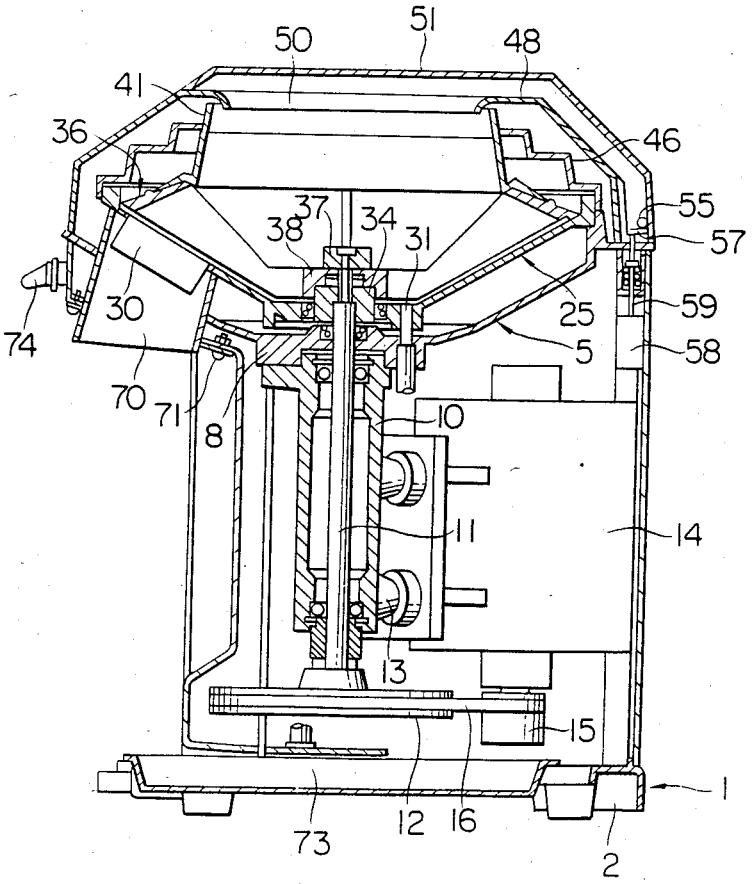
FIG. 1 is a longitudinally sectional size view of a first embodiment of a food slicer according to the present invention.

Referring now to FIGS. 1 to 6, a first preferred embodiment of this invention will be described. In this embodiment, a base 1 has a base plate 2 and four posts 3 standing uprightly thereon. Removably mounted to upper ends of these posts 3 is a flat flange portion 6 of a frame 5. The frame 5 has, in the illustrated embodiment, a concave portion 7 but alternatively, it may have its entire form of a flat plate.

The frame 5 has a central portion formed with a rear boss 8 to which an upper end of a cylindrical shaft housing 10 is fixed. A rotary shaft 11, vertically extending within the housing 10, is supported thereby. The rotary shaft 11 has an upper end portion which passes through a central hole 9 formed in the boss 8 to project upwards and a lower end portion which passes through the housing 10 to project downwards. A pulley 12 is fixed to a lower end of the rotary shaft 11. Supporting arms 13 secured to the housing to extend laterally thereof, and an electric motor 14 is mounted to the supporting arms. A pulley 15 is mounted to a rotary shaft of the electric motor 14, and a belt 16 is applied over the pulleys 12 and 15. As will clearly be seen from FIGS. 4A and 4B, the concave portion 7 has, on its peripheral edge, a pair of lateral U-shaped projections 17 in diametrically opposite relationship. Each of the projections 17 has an identical horizontal slot 18. Also formed on the peripheral edge are a plurality of projections 19 (three in the illustration) which are circumferentially equidistantly spaced. Each of the projections 19 has a low step portion 20. A drain hole 21 is formed in the boss 8, and there is formed in the concave portion 7 an opening 22 into which a discharge chute 70 to be described later is inserted. The drain hole 21 is connected or in communication with a drain pipe 21*a* which passes through a hood to be described later to extend downwardly. In an alternative wherein the frame 5 takes the form of a flat plate as the whole, the projections 17 and 19 may be provided in the same positional relationship as described above.

Figure 5A:
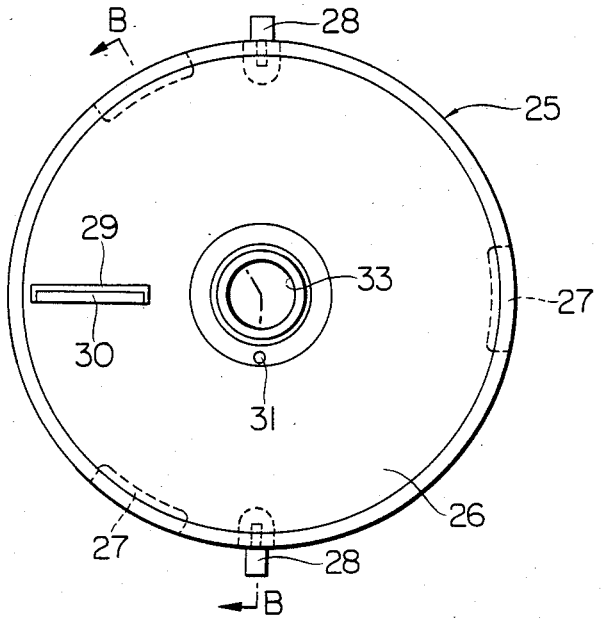
FIG. 5A is a plan view of the cutting plate shown in said first embodiment.
Figure 5B:
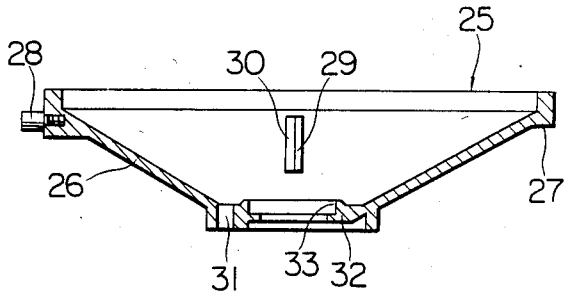
FIG. 5B is a sectional view taken on line B—B and seen in the direction of arrow in FIG. 5A.
Figure 6:
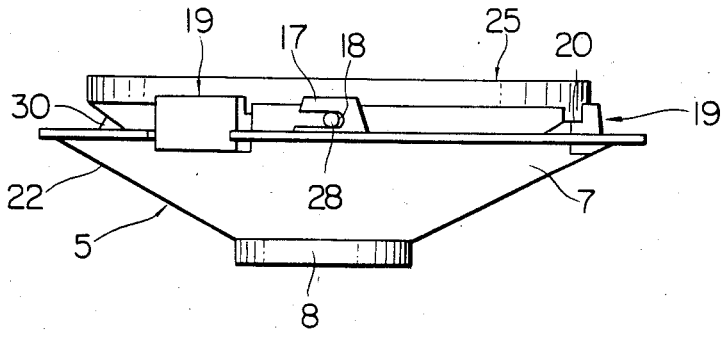
FIG. 6 is a front view showing the frame and cutting plate in combination.
Figure 7:
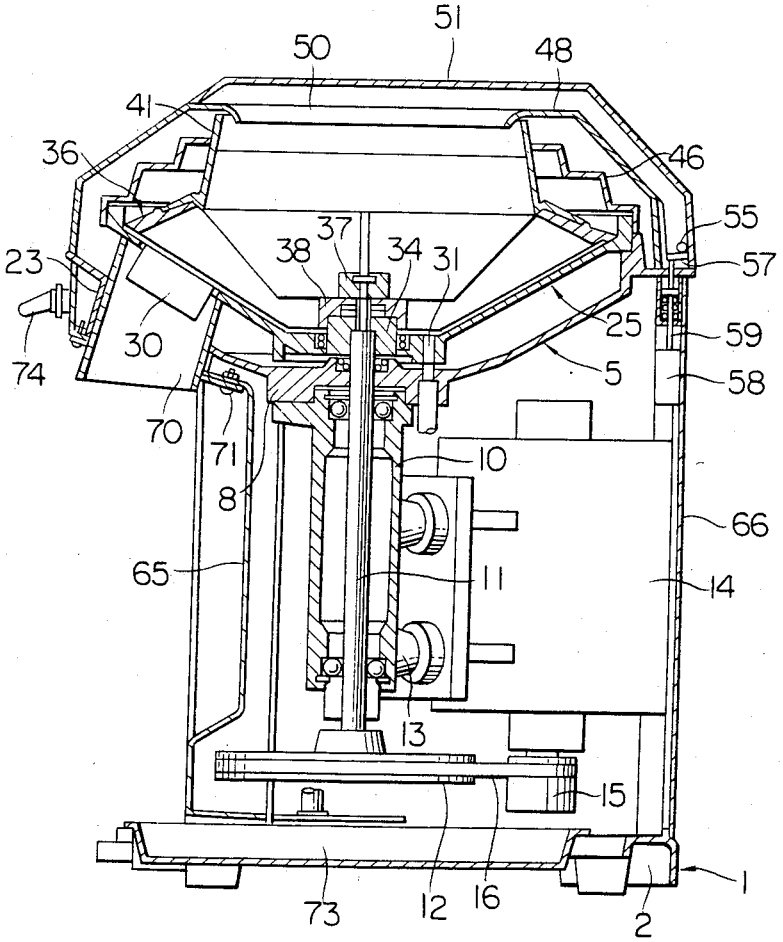
FIG. 7 is a longitudinally sectional side view of a second embodiment of a food slicer according to the present invention.
Figure 8:
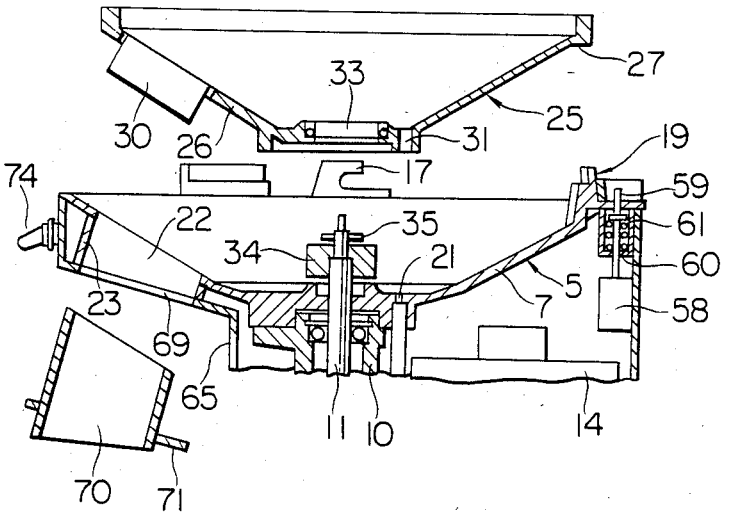
FIG. 8 is an exploded longitudinally sectional enlarged view of part of said second embodiment.
Figure 10:
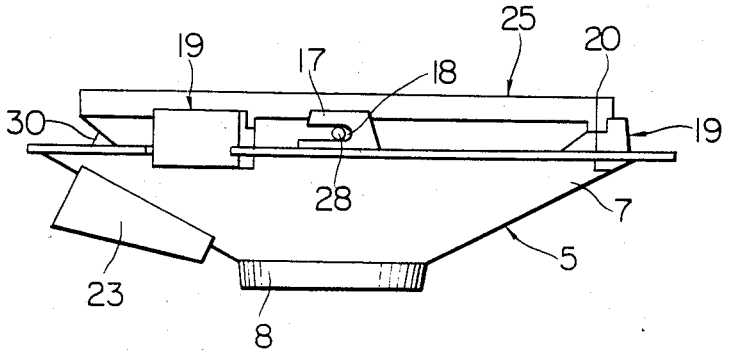
FIG. 10 is a front view showing the frame and cutting plate of said second embodiment in combination.
Figure 9A:
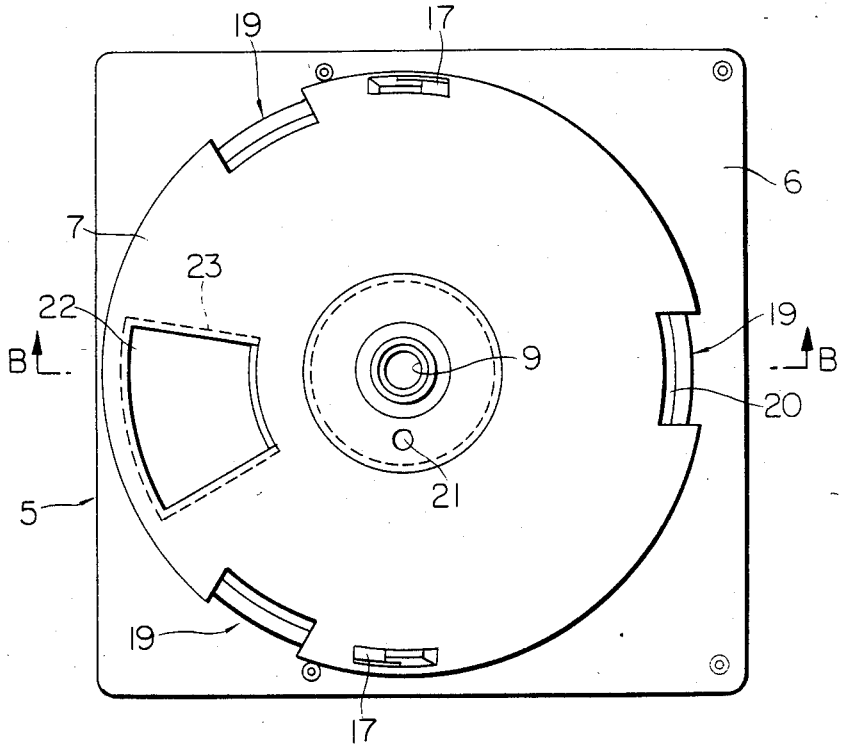
FIG. 9A is a plan view of a frame shown in said second embodiment.
Figure 9B:
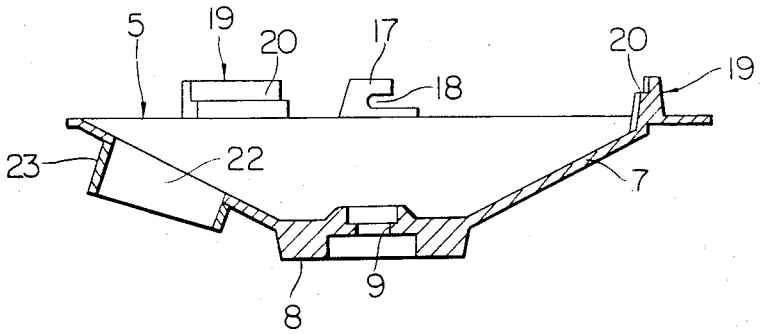
FIG. 9B is a sectional view taken on line B—B and seen in the direction of arrow in FIG. 9A.

A cutting plate 25 has a construction as detailed in FIGS. 5A and 5B. Specifically, the cutting plate 25 has a conical plate body 26 as shown which may alternatively take the form of a flat plate like the frame 5. Formed on the peripheral edge of the plate body 26 are pins 28 which are placed in diametrically opposite relationship to project outwardly. These pins 28 are inserted into the openings 18 in the projections 17 of the frame 5 in bayonet fashion. Upon completion of insertion of the pins 28 in the openings 18, three rear flat portions 27 formed on the peripheral edge of the plate body 26 rest on the corresponding low step portions 20 of projections 19 of the frame 5 to ensure that the cutting plate 25 can be secured to the frame 5 (see FIG. 6). The plate body 26 is formed with an opening 29 at a position which faces the opening 22 in the frame 5 when the frame 5 and the cutting plate 25 are mated. A cutting blade 30 is placed in the opening 29 such that its edge protrudes clear off the opening 29. As in the conventional slicer, the position of the edge of cutting blade 30 can be adjusted by a mounting unit (not shown) disposed in the rear of the plate body 26. The plate body 26 has a central boss 32 formed with a drain hole 31 and a central hole 33 in which the rotary shaft 11 is supported through a bush 34.

Figure 3:
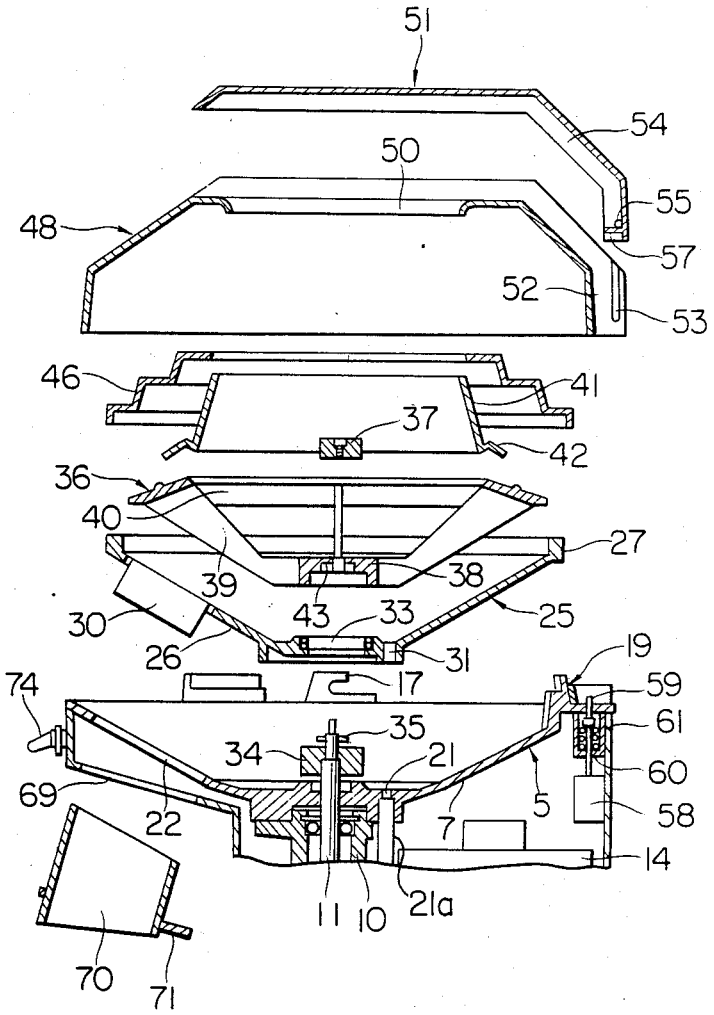
FIG. 3 is an exploded longitudinally sectional enlarged view of part of said first embodiment.
Figure 4A:
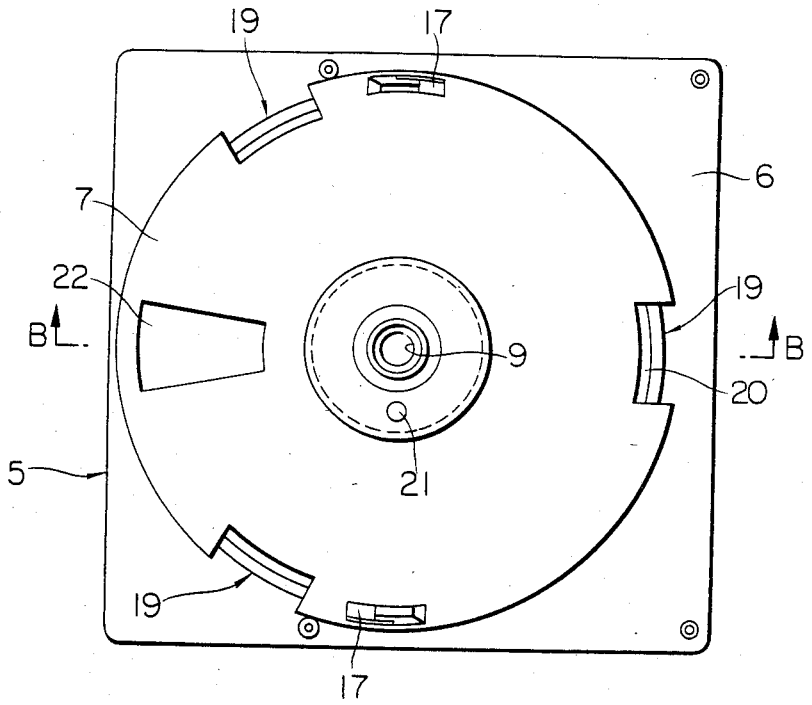
FIG. 4A is a plan view of a frame shown in said first embodiment.
Figure 4B:
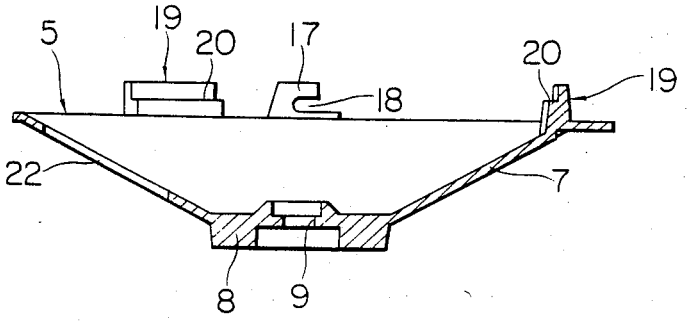
FIG. 4B is a sectional view taken on line B—B and viewed in the direction of arrow in FIG. 4A.

Turning to FIGS. 1 and 3, a lateral pin 35 is inserted in the rotary shaft 11 extending upwards through the cutting plate 25. The lateral pin 35 is slidably fitted in an elongated slit 43 formed in the bottom of a boss 38 of a transfer rotor 36. The transfer rotor 36 comprises a plurality of blades 39 which extend radially from the boss 38 having the central hole 33 through which the rotary shaft 11 passes and have lower surfaces running substantially in parallel with the surface of the cutting plate 25, an annular plate 40 connecting together tip ends of these blades 39, and a hopper 41 having, at its lower peripheral edge, an outwardly extending flange 42 which is removably secured to the annular plate 40 by means of set screws, for example.

Figure 2:
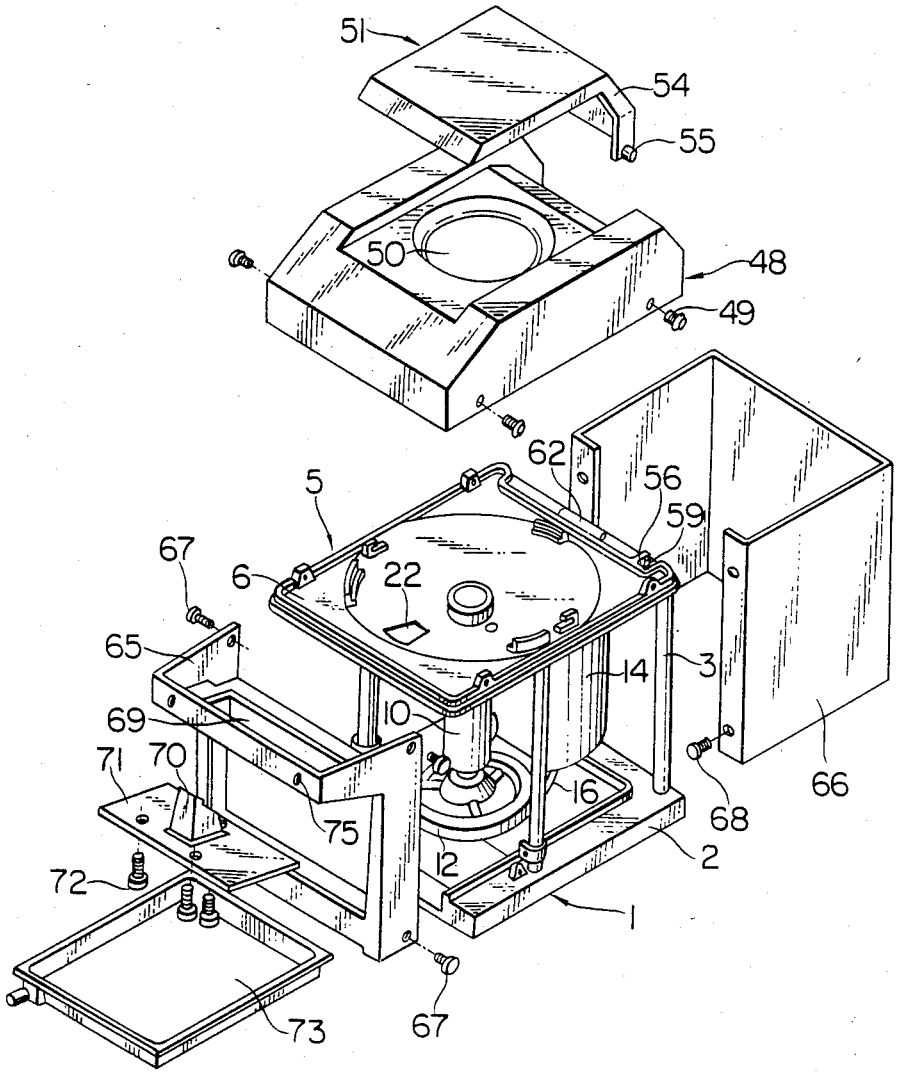
FIG. 2 is an exploded perspective view of said first embodiment removed of a cutting plate, a transfer rotor and a scattering preventive cover.

A cover 46 to prevent scattering surrounds the hopper 41. The cover 46 has a lower end portion the inner periphery of which is fitted on the outer periphery of the cutting plate 25 and removably secured thereto by means of set screws, for example. A head cover 48 further surrounds the cover 46, having a lower end portion with its inner periphery fitted on the outer periphery of the frame 5 and removably secured thereto, for example, by means of set screws 49 as best shown in FIG. 2. The head cover 48 is formed, in its top, with an opening 50, and an openable lid 51 adapted to open or close the opening 50 is removably pivoted at the cover 48. This cover 48 has opposed side walls 52 to leave behind a back spacing therebetween. Formed in the side walls 52 are vertical slits 53 into which horizontal pins 55 extending outwards from opposed side walls 54 of the lid 51 are inserted.

A stopper 62 is provided on the back upper surface of the frame 5, for stopping the lid 51 in the way of opening excursion thereof. Below the back surface is disposed a safety switch 58 standing uprightly (see FIG. 1).

A switch pin 59 of the safety switch 58 is normally biased upwards by means of a spring 61 accommodated in a spring box 60, so that an upper end of the switch pin 59 passes through an opening in the frame 5 to extend upwards within the interior of a recess 56 defined by a circumferential edge projection of the frame 5 (see FIG. 2). Provided for the back portion of the lid 51 is a push plate 57 (see FIG. 3). When the lid 51 is closed, the push plate 57 pushes down the pin 59 to turn on the safety switch 58. When the lid 51 is opened, the push plate 57 disengages the pin 59 which in turn is raised by the spring 61 to turn off the safety switch 58. This safety switch 58 is connected in series with a main switch 74 for connection to the electric motor 14. The main switch 74 is attached to a hood 65 by tightening at mount holes 75 (see FIG. 2).

Turning to FIG. 2, there are illustrated separate front and back hoods 65 and 66 adapted to house a drive mechanism including the rotary shaft 11 and the electric motor 14. These hoods are removably secured to the base 1 by means of set screws 67 and 68. The front hood 65 has a forward opening 69 into which a cover 71 is inserted. The cover 71 is provided with the discharge chute 70 and removably secured to the front hood 65 by means of set screws 72. This chute 70 is associated with the opening 29 and the cutting blade 30 (FIG. 1). Reference numeral 73 designates a drain pan which can be mounted into or dismounted from the base plate 2.

In operation, after the lid 51 has been turned upwards to open the opening 50 and consequently turn off the safety switch 58, solid foodstuffs are thrown into the opening 50 in the head cover 48 so as to be placed inside the cutting chamber comprising the cutting plate 25 and hopper 41. Subsequently, the lid 51 is closed to turn on the safety switch 58 and then the main switch 74 is turned on, thereby driving the electric motor 14 for rotation of the transfer rotor 36. As the transfer rotor 36 rotates, the blades 39 cause the foodstuffs to move around the cutting plate 25 so that the foodstuffs are shaved or sliced by the cutting blade 30 and thereafter discharged exteriorly of the slicer via the opening 29 and discharge chute 70.

When it is desired to clean the cutting plate 25 and transfer rotor 36 after a use of the slicer has been completed, the head cover 48 and the scattering preventive cover 46 are sequentially removed. With the head cover 48 removed, the push plate 57 of the lid 51 disengages the pin 59 and the safety switch 58 is turned off in the same manner as when opening the lid.

With the safety switch 58 turned off, the electric motor 14 will not be driven even in the event that the main switch 74 is inadvertently turned on, thereby preventing an unwanted trouble that an accidental rotation of the transfer rotor 36 injures the operator or causes the object to be sliced to scatter.

Then, the transfer rotor 36 is removed by releasing the nut 37 from the rotary shaft 11. Thereafter, the cutting plate 25 is removed from the frame 5 by turning the cutting plate 25 clockwise as viewed from above in FIG. 6 to draw out the pin 28 from the opening 18. The thus removed transfer rotor 36 and cutting plate 25 are cleaned. In order to eliminate remnants or dregs, though slight in amount, which have dropped from the cutting plate 25 to deposit on the upper surface of the fixed frame 5, the fixed frame 5 can be cleaned as it remains unremoved and contaminated water can be discharged via the drain hole 21. After the completion of cleaning as above, the cutting plate 25 and the transfer rotor 36 are returned and held in place for reassembling through converse prosedures. Since, in the food slicer according to the previous embodiment of the present invention, the transfer rotor and the cutting plate are removable, remnants of foodstuffs deposited on these members can be eliminated safely by cleaning their entire outer peripheral surface on the outside of the slicer, without taking a particular care and requiring much labor. In addition, the remnants deposited on the frame can also be eliminated by cleaning this member as it remains unremoved in a similar manner. Accordingly, sliced foods, which are clean and good for sanitation, can always be obtained.

To describe a second embodiment of this invention, reference should be made to FIGS. 7 to 10.

The second embodiment resembles the first embodiment in most parts, and members of the second embodiment identical to those of the first embodiment are designated by identical reference numerals and different parts only will be described.

What is different from the first embodiment is such that a cylindrical apron 23 is added which surrounds the discharge chute 70. The apron 23 has an upper end connected or secured to a rear circumferential surface portion contiguous to the opening 22 in the frame 5 and a lower end abutting against a circumferential surface portion contiguous to the opening 69 for insertion of the discharge chute 70. Alternatively, the apron 23 may have a lower end connected or secured to the circumferential surface portion contiguous to the opening 69 and an upper end abutting against the rear circumferential surface portion contiguous to the opening 22 in the frame 5.

When cleaning the surface of the frame 5, the discharge chute 70 can first be removed for the reason described below according to the second embodiment and the cleaning is carried out in a similar manner to the first embodiment. Because of the removal of the discharge chute 70 otherwise projecting beyond the surface of the frame 5, satisfactory cleaning can be accomplished very readily. Even with the discharge chute 70 removed, the apron 23, added according to teachings of the second embodiment, can completely prevent contaminated water for cleaning from intruding into the interior of the hood via a space between the rear surface of frame 5 and the hood 65. Advantageously, this can ensure steady prevention of soiling of the driving members arranged inside the hood.

In the foregoing embodiments, the pin 28 of the cutting plate 25 can be engaged with or disengaged from the opening 18 of the lateral U-shaped projection 17 of the frame 5 by simply turning the cutting plate 25 in the horizontal plane, thereby accomplishing engagement or disengagement of both the members 5 and 25. Under the engagement, the flat portion 27 of the cutting plate 25 rests on the inner low step portion 20 of the projection 19 positioned on the frame 5 corresponding to the flat portion 27, so that the spacing between the two members 5 and 25 can be maintained automatically and stably. However, it should be understood that the coupling mechanism for the two members is in no way limited to the bayonet type as in the precedence but any type of coupling mechanism capable of attaining a similar function may be employed.

The invention has been described in detail sufficient to enable one of ordinary skill in the art to make and use the same. It is believed that certain modifications and alternatious of two preferred embodiment will occur to others upon a reading and understanding of the specification, and it is intended to include all such alternations and modifications as part of the invention, insofar as they come within the scope of the appended claims.

What is claimed is:

1. In a food slicer comprising:

a cutting plate having a plate body mounted, at its rear surface, with a cutter having a cutting edge which passes through an opening formed in said plate body and projects beyond the surface thereof;

a transfer rotor mounted to an upper portion of a rotary shaft which passes through a central hole in said cutting plate to extend beyond said cutting plate and including a hopper secured to an upper portion of said transfer rotor; and a drive member, disposed beneath said cutting plate, for rotating said rotary shaft, the improvement wherein said cutting plate is removably mounted by a quick disconnect to a frame which is mounted to posts standing uprightly on a base below said cutting plate, said frame rotatably supports said rotary shaft;

said transfer rotor is removably secured to said rotary shaft;

a hood is mounted to said base, for surrounding a region in which said drive member is arranged beneath said frame; and a discharge chute is mounted to said hood, which discharge chute passes through an opening formed in said frame to extend upwards and has an upper end abutting against a circumferential portion contiguous to said opening formed in said plate body of said cutting plate, said frame takes the form of a closed plate except for said opening through which said discharge chute passes, thereby providing a leakage preventive plate for closing a top opening of said hood, and said frame is connected with a drain pipe which passes through said hood to extend downwardly.

2. A food slicer according to claim 1 wherein a cylindrical apron is arranged to surround said discharge chute, and upper and lower ends of said apron are contiguous to said frame and hood, respectively.

3. A food slicer according to any one of claims 1 to 2 wherein said frame has, on its peripheral edge portion, a pair of lateral U-shaped projections arranged in diametrically opposite relationship with respect to a center of a bearing hole for said rotary shaft and having identical openings in the horizontal direction, said frame further has, on its peripheral edge portion, a plurality of projections which are circumferentially equidistantly spaced, each of said projections has an inner low step portion, and said plate body of said cutting plate has a pair of outwardly projecting pins which engage or disengage said openings of said lateral U-shaped projections and further has flat portions which rest on said low step portions of said projection when said pins engage said openings of said lateral U-shaped projections.

4. A food slicer according to any one of claims 1 to 2 wherein a cover having a substantially central opening is removably mounted to said frame to surround an upper portion of said hopper, an openable lid is pivotally mounted to said cover to open or close said central opening thereof, and a safety switch is mounted to said frame, which safety switch is turned on only when said lid is closed and is connected to said drive member for rotating said transfer rotor.

5. The apparatus of claim 1 wherein said frame and said cutting plate have substantially parallel conical surfaces spaced from each other.

* * * * *